United States Patent [19]

Nishimura et al.

[11] Patent Number: 4,690,110

[45] Date of Patent: Sep. 1, 1987

[54] VARIABLE VALVE MECHANISM FOR INTERNAL COMBUSTION ENGINES

[75] Inventors: Hirofumi Nishimura; Yasuyuki Morita, both of Hiroshima, Japan

[73] Assignee: Mazda Motor Corporation, Hiroshima, Japan

[21] Appl. No.: 855,436

[22] Filed: Apr. 24, 1986

[30] Foreign Application Priority Data

Apr. 26, 1985 [JP] Japan ..... 60-91564
Apr. 26, 1985 [JP] Japan ..... 60-91565
Apr. 26, 1985 [JP] Japan ..... 60-91567

[51] Int. Cl.[4] ..... F01L 1/34

[52] U.S. Cl. ..... 123/90.17; 123/90.22; 123/90.4

[58] Field of Search ..... 123/90.22, 90.39, 90.4, 123/90.45, 90.6, 90.15, 90.16, 90.17, 90.21, 90.27

[56] References Cited

U.S. PATENT DOCUMENTS 4,354,460 10/1982 Mae et al. ..... 123/90.16
4,448,156 5/1984 Henault ..... 123/90.17
4,534,323 8/1985 Kato et al. ..... 123/90.44
4,556,025 12/1985 Morita ..... 123/90.16
4,561,391 12/1985 Simko ..... 123/90.27
4,627,391 12/1986 Derringer ..... 123/90.16

FOREIGN PATENT DOCUMENTS 0052554 5/1982 European Pat. Off. .
2493915 5/1982 France .
57-182205 11/1982 Japan .

*Primary Examiner*—Craig R. Feinberg
*Assistant Examiner*—David A. Okonsky
*Attorney, Agent, or Firm*—Fleit, Jacobson, Cohn & Price

[57] ABSTRACT

A variable valve mechanism for an internal combustion engine including a central cam of a smaller lift and a pair of side cams located at the opposite sides of the central cam symmetrically with each other with respect to the central cam. A rocker arm device includes a pair of side arm sections engaged respectively with the side cams and a central arm between the side arm sections. The central arm is engaged at one end with the engine valve and at the other end with the central cam. A connecting device is provided for connecting the side arm sections with the central arm under a high speed.

12 Claims, 8 Drawing Figures

VARIABLE VALVE MECHANISM FOR INTERNAL COMBUSTION ENGINES

BACKGROUND OF THE INVENTION

1. Field of the Invention

The present invention relates to a valve operating mechanism for an internal combustion engine. More particularly, the present invention pertains to a variable valve mechanism wherein the lift and/or the valve opening period can be changed in accordance with the engine operating conditions.

2. Description of the Prior Art

In internal combustion engines, it has been well known that the overlap period between intake and exhaust valves be as small as possible under a low speed engine operation for the purpose of decreasing the suck back of the exhaust gas and the blow back of the intake mixture which may otherwise cause combustion instability and poor fuel economy. For the purpose, it is advisable to make the valve lift and the valve open period as small as possible. However, under a high speed engine operation, it is desirable to increase the valve lift and the valve open period so that an adequate intake mixture change can be provided for high output engine operations.

To comply with such demand, it has already been proposed to provide a plurality of valve actuating cams of different configuration so that one of such cams is selectively used in accordance with the engine operating condition to provide a desired valve operation. For example, Japanese utility model application No. 56-69407 filed on May 15, 1981 and disclosed for public inspection on Nov. 18, 1982 under the disclosure No. 57-182205 discloses a variable valve actuating mechanism including a rocker arm swingable about a rocker shaft and a pair of valve actuating cams, one for high speed engine operation and the other for low speed engine operation. The rocker arm is provided at one end with a first tappet engaging surface which is held in contact with the low speed cam and with a second tappet engaging member for engagement with the high speed cam. The second tappet engaging member is mounted slidably on the rocker arm and a stopper is provided for restricting the sliding movement of the second tappet engaging member when the stopper is in the operative position. In order to move the stopper between the operative position and an inoperative position, an actuator is provided.

It will therefore be understood that, when the stopper is in the inoperative position, the second tappet engaging member is freely slidable so that the low speed cam functions to operate the rocker arm. When the stopper is actuated to the operative position, however, the second tappet engaging member is locked against the slidable movement so that the high speed cam functions to operate the rocker arm to thereby increase the valve lift and the valve open period. It should be noted however that it is unavoidable to provide a certain extent of gap between the second tappet engaging member and the rocker arm in order to allow the aforementioned sliding movement of the second tappet engaging member. Such gap will then produce a sideward play of the second tappet engaging member under a side thrust which will possibly be given by the high speed cam to the second tappet engaging member. Thus, noise may possibly be produced and wear of the sliding surfaces will be accelerated. Further disadvantages in this type of mechanism are that the mechanism is complicated and the inertia of the rocker arm is increased due to the complicated mechanism provided mostly on one end of the rocker arm. Such increase in the inertia of the rocker arm may sometimes cause a jumping of the valve under a high speed engine operation so that the top speed of the engine may have to be decreased.

In the U.S. Pat. No. 4,448,156 which corresponds to the published French patent application No. 2,493,915 and the European patent publication No. 52,554, there is disclosed a valve actuating mechanism including a pair of cams of different shape which are respectively engaged with cam engaging rocker arms swingably mounted on a common rocker shaft. Between the cam engaging rocker arms, there is a valve engaging rocker arm which is mounted at one end swingably on the common rocker shaft. Between the valve engaging rocker arm and the cam engaging rocker arms, there are respectively provided dog clutch devices so that the valve engaging rocker arm is engaged alternately with either one of the cam engaging rocker arms to swing therewith as a unit. The valve engaging rocker arm is mounted on the rocker shaft for slidable movement along the axis of the rocker shaft to be alternately engaged with one of the cam engaging rocker arms. It should however be noted that the mechanism proposed by the U.S. patent is disadvantageous in that the valve engaging rocker arm must be offset with respect to the valve tappet.

A further disadvantage common to the aforementioned known structures is that the valve operating force is transmitted from the cams to the rocker arm in an offset manner so that a smooth movement of the rocker arm is disturbed and wear of the rocker arm is accelerated. In the conventional arrangements, a pair of cams are provided in a side-by-side relationship, one for the low speed operation and the other for the high speed operation so that the valve operating force is transmitted to the rocker arm always from either one of the cams, so that the aforementioned problems are produced.

SUMMARY OF THE INVENTION

It is therefore an object of the present invention to provide an engine valve mechanism in which one or both of the valve lift and the valve open period can be changed with a simple and reliable mechanism.

Another object of the present invention is to provide a variable valve mechanism in which valve operating force is transmitted from the cams to the rocker arm in a symmetric manner.

A further object of the present invention is to provide a variable valve mechanism in which smooth operations of the rocker arm can be ensured and wear of the rocker arm can be prevented.

Still further object of the present invention is to provide a variable valve operating mechanism in which the inertia of the rocker arm can be decreased.

According to the present invention, the above and other objects can be accomplished by an engine valve mechanism including cam means having two types of cams of different shapes which are rotated synchronously with engine rotation, rocker arm means adapted to be operated by selected one of said two types of cams for operating valve means characterized by the fact that said cam means includes a central cam of a first type and a pair of side cams of a second type which are disposed at the opposite sides of and symmetrically with respect to the central cam.

With this arrangement, it is possible to transmit the valve operating force in a symmetric manner from the cams to the rocker arm means. It is therefore possible to ensure smoother operations of the rocker arm and prevent local wears of the rocker arm and the cams. In order to make the selected type of cam effective to operate the rocker arm, the rocker arm may be divided into two parts, the first one having a valve engaging rocker arm section and a cam engaging rocker arm section for engagement with the cam or cams of one type and the second one having a cam engaging rocker arm section for engagement with the cam or cams of the other type. Connecting means may be provided between the first and second parts of the rocker arm for connecting them together. When the parts of the rocker arm are disconnected, the first part functions to transmit the valve operating force. However, when the two parts of the rocker arm is connected together, the valve operating force is transmitted from the second part to the first part to operate the valve. Preferably, the side cam is of a configuration such that the central cam is fully contained in the confine of the side cam. This configuration will facilitate machining of the cams.

The above and other objects and features of the present invention will become apparent from the following descriptions of preferred embodiments taking reference to the accompanying drawings.

DESCRIPTION OF THE PREFERRED EMBODIMENTS

Referring now to FIGS. 1 through 4, there is shown an embodiment including a pair of intake valves 2*a* and 2*b* and a pair of exhaust valves (not shown) for each cylinder 1. A camshaft 5 is provided and formed with a pair of high speed cams 3*a* and 3*b* of the same shape and a low speed cam 4 of a different shape. The cam 4 is located between the cams 3*a* and 3*b*. The high speed cams 3*a* and 3*b* have cam lobes which are larger than the cam lobe in the low speed cam 4 so that the cams 3*a* and 3*b* can provide greater cam lift and cam open period than the cam 4. It should however be noted that the cams 3*a* and 3*b* may be such that one of the cam lift and the valve open period can be increased as compared with the low speed cam 4.

Figure 1:
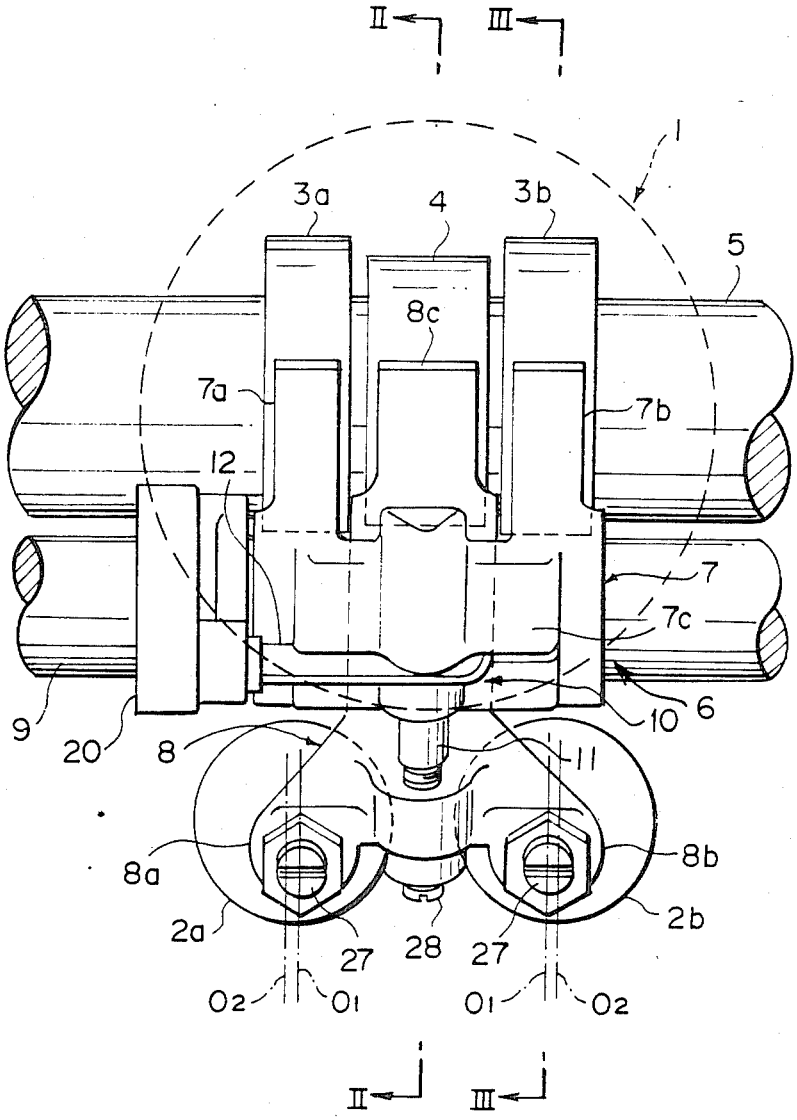
FIG. 1 is a plan view showing the valve operating mechanism in accordance with one embodiment of the present invention.

There is a rocker arm arrangement 6 which includes a cam engaging arm 7 having arm sections 7*a* and 7*b* which are engaged with the high speed cams 3*a* and 3*b*. The rocker arm arrangement 6 further includes a second arm 8 which is bifurcated at one end to provide arm sections 8*a* and 8*b* engaged with the intake valves 2*a* and 2*b*. The arm 8 has at the other end a cam engaging arm section 8*c* which is engaged with the low speed cam 4. As shown in FIG. 1, the arm 8 is located between the arms sections 7*a* and 7*b* of the arm 7. Thus, the arm 7 has a bridge 7*c* which connects the arm sections 7*a* and 7*b* and located to pass over the arm 8. The arms 7 and 8 are swingably mounted on a rocker shaft 9.

In order to releasably connect the arm 7 with the arm 8, there is provided a locking device 10 which includes a plunger 11 received slidably in a cylindrical bore 13 formed in the bridge 7*c* of the arm 7. In the bore 13, there is a coil spring 14 which biases the plunger 11 outwards. An adjust screw 28 is provided on the arm 8 at a position between the valve engaging arm sections 8*a* and 8*b*. The plunger 11 is maintained in an abutting engagement with the adjust screw 28.

Figure 2:
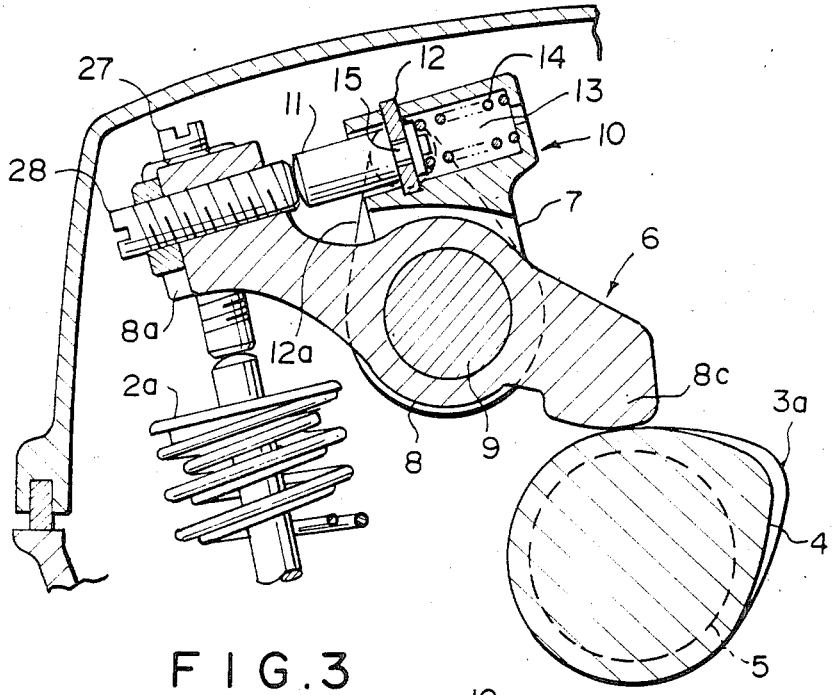
FIG. 2 is a sectional view taken along the line II—II in FIG. 2.
Figure 3:
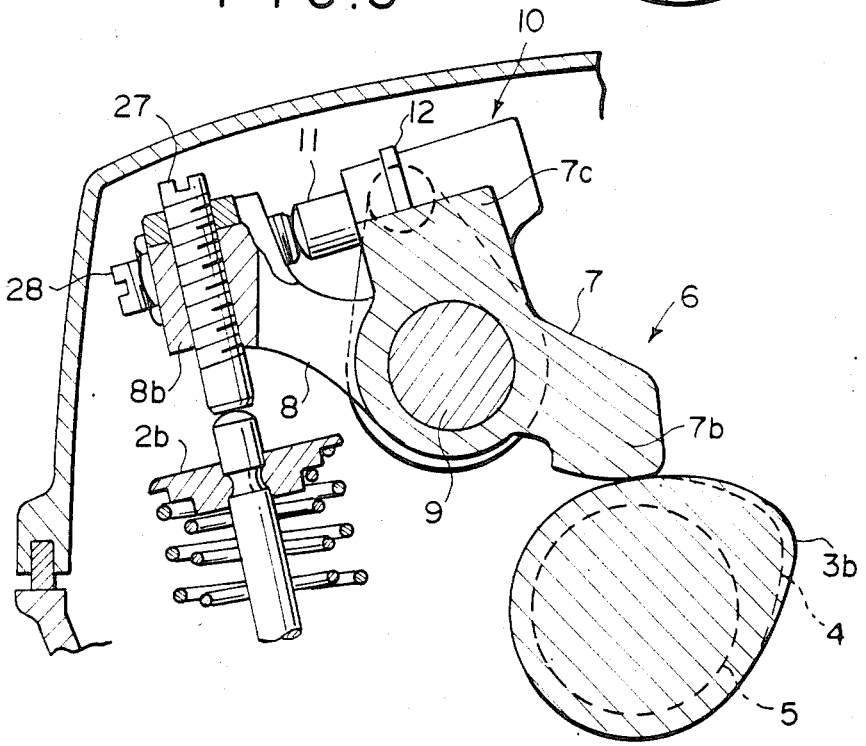
FIG. 3 is a sectional view taken along the line III—III in FIG. 2.
Figure 4:
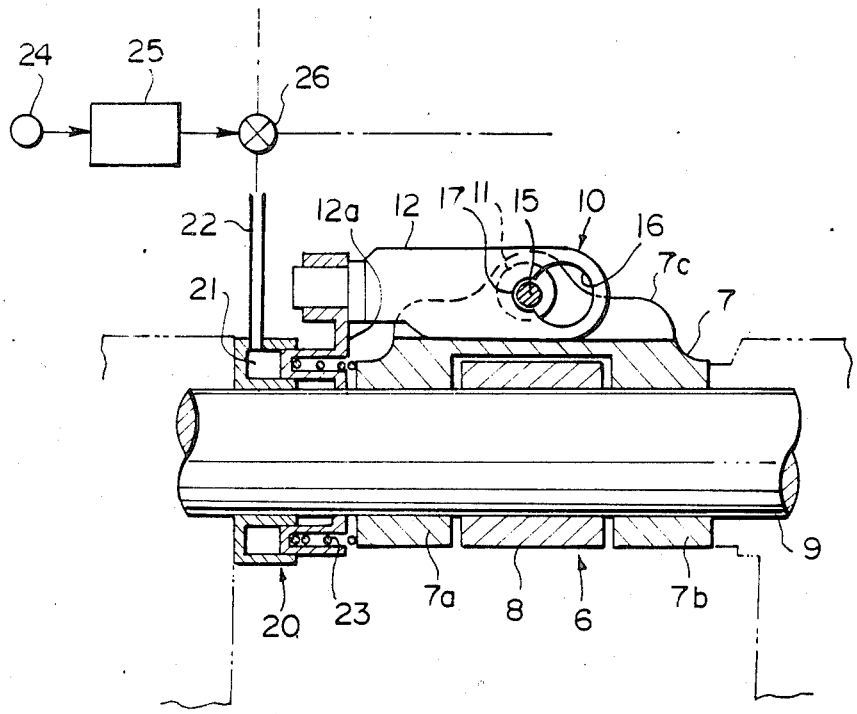
FIG. 4 is a sectional view taken along the rocker shaft.

As shown in FIGS. 2 and 4, the plunger 11 is formed with a small diameter portion 15 and a locking plate 12 is provided for engagement with the small diameter portion 15 of the plunger 11. The locking plate 12 extends in a direction perpendicular to the plunger 11 and formed with a double diameter hole including a large diameter unlocking portion 16 and a small diameter locking portion 17 as shown in FIG. 4. The plunger 11 is passed through the double diameter hole in the locking plate 12. It will be understood that when the plunger 11 passes through the unlocking portion 16 of the hole, the plunger 11 is free to slide in the bore 13 so that the arms 7 and 8 can be swung independently from each other. The valve engaging arm sections 8*a* and 8*b* on the arm 8 are provided with adjust screws 27 which are engaged with the tappets in the valves 2*a* and 2*b* as shown in FIGS. 2 and 3. Therefore, swinging movements produced in the arm 8 are transmitted to the valves 2*a* and 2*b* to operate them. However, swinging movements produced in the arm 7 are not transmitted to the arm 8 so that the valve operations are made only by the low speed cam 4.

When the locking plate 12 is shifted to the position shown in FIG. 4, the locking portion 17 of the hole is engaged with the small diameter portion 15 in the plunger 11 so that the plunger 11 is locked against the axial movement. Thus, the swinging movements of the arm 7 are transmitted to the arm 8 to operate the valves 2*a* and 2*b*. The valves 2*a* and 2*b* are therefore operated by the high speed cams 3*a* and 3*b*.

In order to move the locking plate between the locking and unlocking positions, there is provided an actuator 20 which includes a cylinder 21 and a piston 12*a* which is slidable in the cylinder 21 and connected with the locking plate 12. A conduit 22 is connected with the cylinder 21 to supply a hydraulic pressure through a control valve 26. The control valve 26 is controlled in accordance with the engine speed. For the purpose, there is an engine speed detector 24 having an output connected with a control circuit 25. The control circuit 25 produces an output when the engine speed is beyond a predetermined valve to actuate the control valve 26 so that the hydraulic pressure is supplied to the cylinder 21. The pressure in the cylinder 21 forces the piston 12*a* rightward in FIG. 4 to thereby shift the plate 12 to the locking position. A return spring 23 is provided to force the piston 12*a* leftward in FIG. 4 so that the piston 12*a* and the locking plates 12 are moved to the unlocking postion. It will of course be noted that any type of actuator can be used for moving the locking plate 12.

The arrangements described above are advantageous in that the plunger 11 is subjected only to axially directed forces so that it is unlikely that a lateral play is produced in the movement of the plunger 11. Further, the locking device 10 is located in the vicinity of the rocker shaft 9 so that the inertia of the rocker arm arrangement 6 is decreased. In FIG. 4, it will be noted that the actuator 20 is formed separately from the rocker arms and mounted on the rocker shaft 9. This arrangement is effective to further decrease the weight and the inertia of the rocker arms. In this embodiment, the valve clearance for the low speed cam 4 can be adjusted by the adjust screw 27 on the arm sections 8*a* and 8*b*. The valve clearance for the high speed cams 3*a* and 3*b* can be adjusted by the adjust screw 28.

It will be understood that the high speed cams 3*a* and 3*b* of the identical shape are located at the opposite sides of the low speed cam 4 symmetrically to each other with respect to the low speed cam 4. Therefore, valve actuating forces are transmitted from the cams to the rocker arm 8 in a symmetrical manner. It is therefore possible to ensure a smooth operations of the arms 7 and 8 and prevent local uneven wear of the parts.

Figure 5:
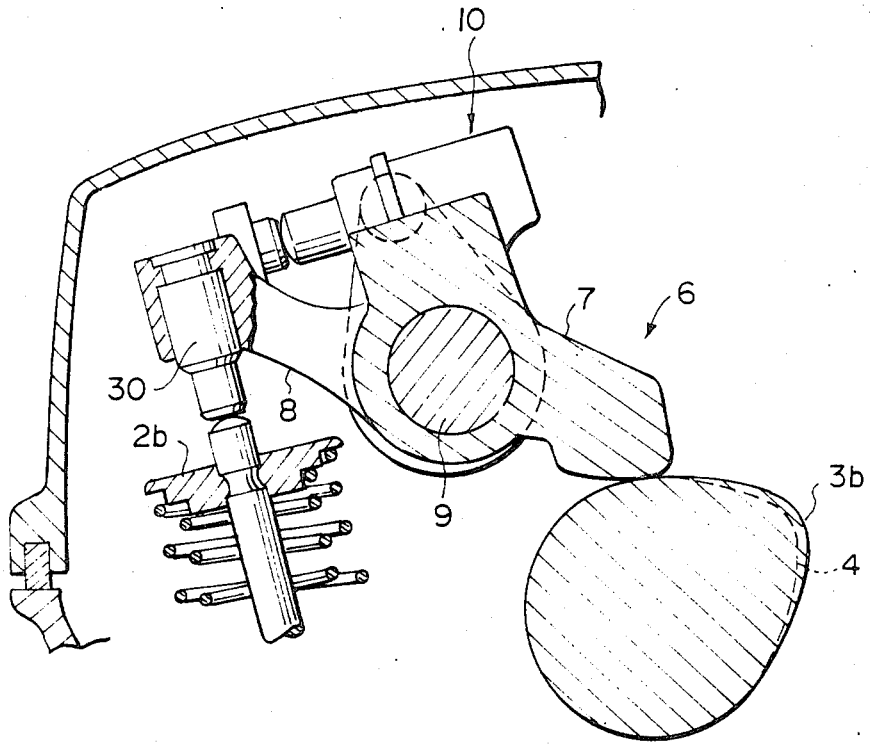
FIG. 5 is a sectional view similar to FIG. 3 but showing another embodiment.

FIG. 5 shows another embodiment in which the adjusting screws 27 and 28 in the previous embodiment are omitted and substituted by a lash adjuster 30 of a known type.

Figure 6:
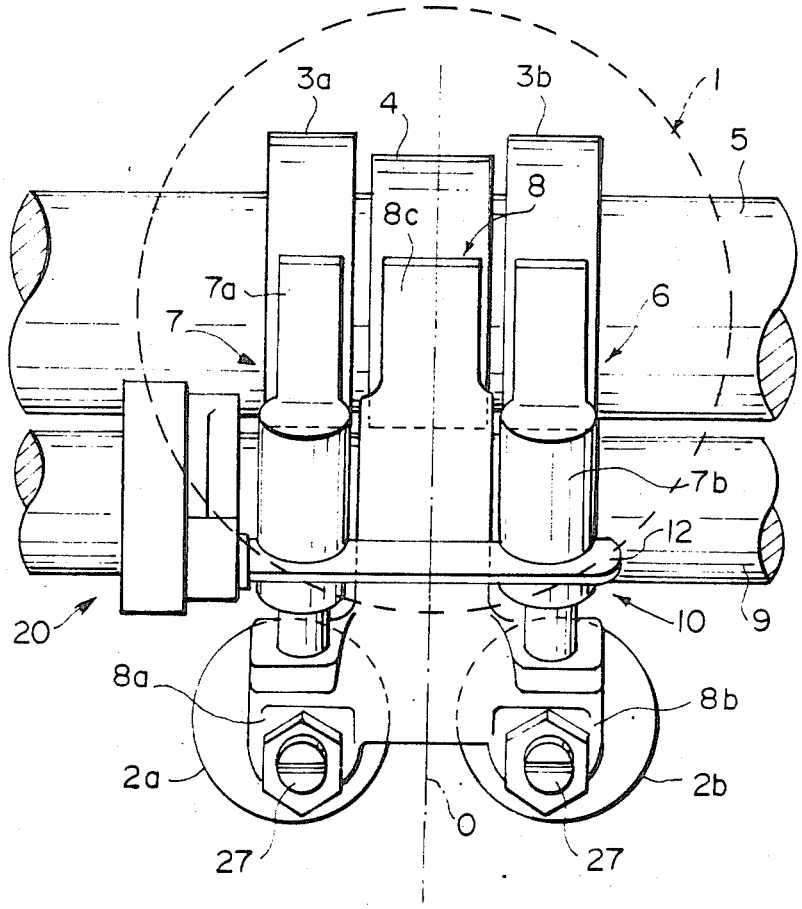
FIG. 6 is a plan view showing another embodiment of the present invention.
Figure 7:
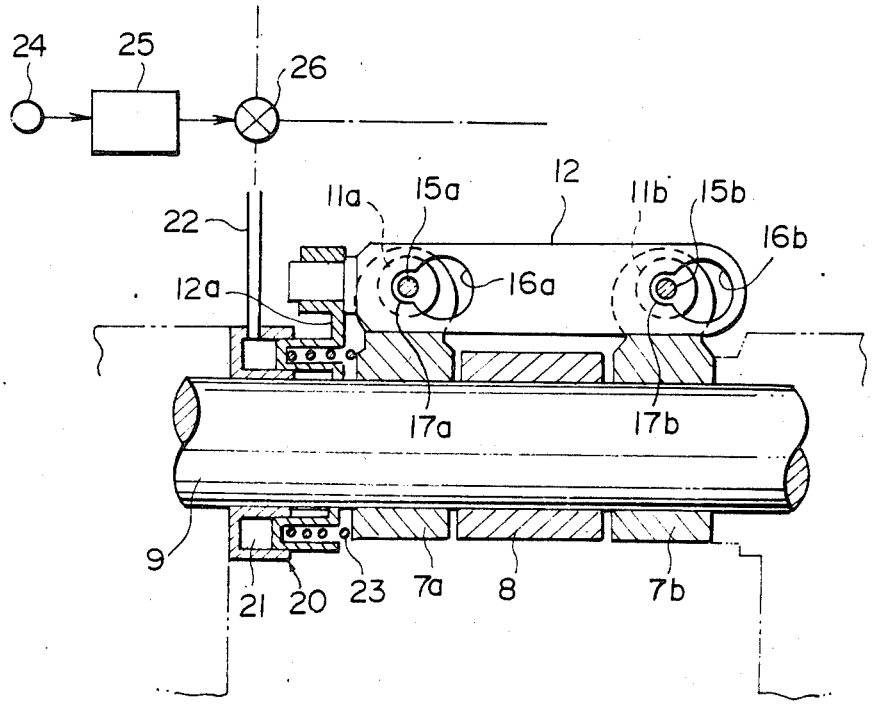
FIG. 7 is a sectional view showing the locking device adopted in the embodiment of FIG. 6; and, FIG. 8 is a sectional view similar to FIG. 2 but showing a further embodiment.

Referring now to FIGS. 6 and 7, the embodiment shown therein is different from the embodiment shown in FIGS. 1 through 4 in that the rocker arm 7 includes separately formed arm sections 7*a* and 7*b* which are adapted for engagement with the high speed cams 3*a* and 3*b*, respectively. The locking device 10 includes plungers 11*a* and 11*b* which are respectively mounted on the arm sections 7*a* and 7*b* and have small diameter portions 15*a* and 15*b*, respectively. The locking plate 12 of the locking device 10 has a pair of holes including large diameter unlocking portions 16*a* and 16*b* and small diameter locking portion 17*a* and 17*b* for receiving the plungers 11*a* and 11*b*. When the plungers 11*a* and 11*b* are passed through the unlocking portions 16*a* and 16*b*, respectively, the arm sections 7*a* and 7*b* are disconnected from the arm 8. When the small diameter portion 15*a* and 15*b* of the plungers 11*a* and 11*b* are engaged with the locking portions 17*a* and 17*b*, respectively, the arm sections 7*a* and 7*b* are connected with the arm 8 so that the valves 2*a* and 2*b* are operated by the high speed cams 3*a* and 3*b*. In other respects, the arrangements are the same as in the embodiment shown in FIGS. 1 through 4 so that descriptions will not be repeated.

Figure 8:
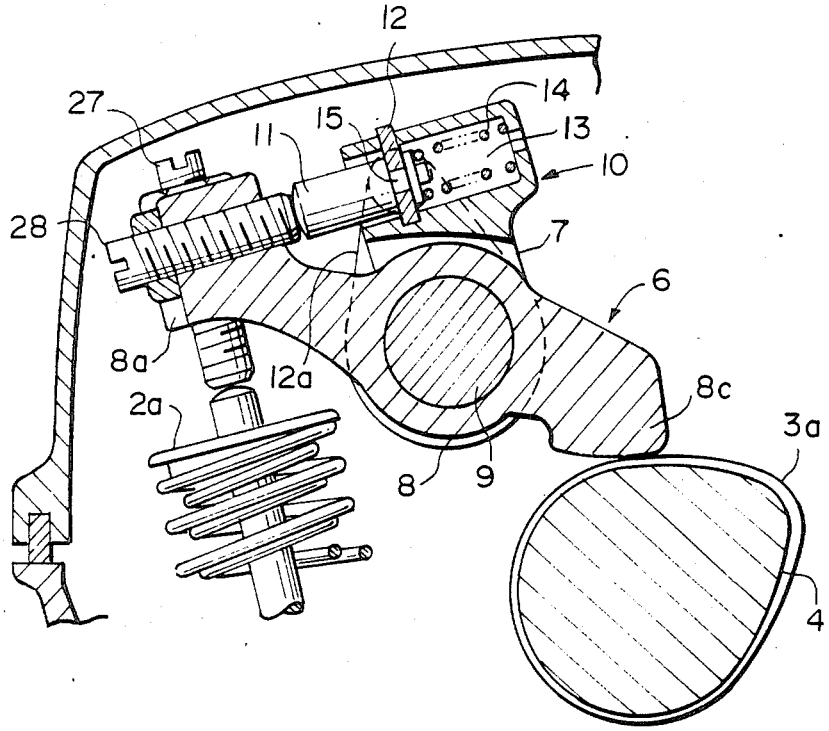

Referring to FIG. 8, the embodiment shown therein is substantially identical to the embodiment shown in FIGS. 1 through 4. The only difference in this embodiment is that the low speed cam 4 is small than the high speed cams 3*a* and 3*b* throughout its periphery, so that the cam 4 is included fully within the confine of the cams 3*a* and 3*b*. This arrangement is advantageous in that the cams 3*a* and 3*b* can be machined simultaneously to precisely identical configurations.

The invention has thus been shown and described with reference to specific embodiments, however, it should be noted that the invention is in no way limited to the details of the illustrated structures but changes and modifications may be made without departing from the scope of the appended claims.

We claim:

1. A valve mechanism for an internal combustion engine including cam means having two types of cams of different shapes which are rotated synchronously with engine rotation, rocker arm means adapted to be operated by selected one of said two types of cams for operating valve means, characterized by the fact that said cam means includes a central cam of a first type and a pair of side cams of a second type which are disposed at the opposite sides of and symmetrically with respect to the central cam.

2. A valve mechanism in accordance with claim 1 in which said rocker arm means includes a first arm mounted swingably on a rocker shaft and engaged with said side cams to be swingably operated thereby, and a second arm mounted swingably on said rocker shaft and engaged at one end with said central cam and at the other end with said valve means, connecting means being provided to releasably lock said first arm on said second arm.

3. A valve mechanism in accordance with claim 2 in which said first arm has bifurcated ends straddling said second and engaged with said side cams, said first arm further having a bridge portion between said bifurcated ends, said connecting means including plunger means mounted on one of said bridge portion of said first arm and a portion of said second arm facing to said bridge portion for axial slidable movement against the other of said bridge portion and said portion on said second arm, locking means being provided for locking the plunger means in a projected position.

4. A valve mechanism in accordance with claim 3 in which said locking means includes a locking member movable in a direction perpendicular to said plunger means for a locking engagement with said plunger means and driving means for driving said locking member.

5. A valve mechanism in accordance with claim 3 in which said locking means includes a locking member movable in a direction perpendicular to said plunger means for a locking engagement with said plunger means and hydraulic driving means for driving said locking member.

6. A valve mechanism in accordance with claim 2 in which said valve means includes two valves, said other end of the second arm being bifurcated and engaged with said two valves for operating the two valves simultaneously.

7. A valve mechanism in accordance with claim 2 in which said central cam has a lift which is smaller than that of the side cams, control means being provided for engaging the connecting means under a high speed engine operation and disengaging the connecting means under a low speed engine operation.

8. A valve mechanism in accordance with claim 1 in which said central cam has a profile which is within a confine of profile of said side cam.

9. A valve mechanism in accordance with claim 1 in which said rocker arm means includes a central arm having one end engaged with said valve means and the other end engaged with said central cam, and a pair of side arms located at the opposite sides of said central arm and engaged respectively with said side cams, connecting means for connecting each of said side arms with said central arm.

10. A valve mechanism in accordance with claim 1 in which said valve means includes a pair of valves located symmetrically to each other with respect to said central cam.

11. A valve mechanism for an internal combustion engine including valve means, cam means comprising a central cam of a smaller lift and a pair of side cams having the same configuration for providing a larger lift and located at the opposite sides of the central cam, a first rocker arm swingably mounted on a rocker shaft and having bifurcated ends engaged respectively with said side cams, a second rocker arm swingably mounted on said rocker shaft between said bifurcated ends of the first rocker arm and having one end engaged with said central cam and the other end with said valve means, said first rocker arm having a bridge portion between said bifurcated ends and straddling said second rocker arm, a plunger mounted on said bridge portion of the first rocker arm for axial sliding movement toward and away from said second rocker arm between a projected postion and a retracted position, abutting means provided on said second arm for abutting engagement with said plunger when said plunger is in the projected position, a locking member movable in a direction perpendicular to said plunger between an operative position wherein the locking member locks said plunger in the projected position and an inoperative position wherein the locking member is disengaged from said plunger, actuator means for moving said locking member to the inoperative position under a low engine speed and to the operative position under a high engine speed.

12. A valve mechanism for an internal combustion engine including valve means, cam means comprising a central cam of a smaller lift and a pair of side cams having the same configuration for providing a larger lift and located at the opposite sides of the central cam, a first side arm swingably mounted on a rocker shaft and engaged with one of said side cams, a second side arm swingably mounted on the rocker arm and engaged with the other of said side cams, a central rocker arm swingably mounted on said rocker shaft between said the first and second side arms and having one end engaged with said central cam and the other end with said valve means, a first and second plungers mounted respectively on said first and second arms for axial sliding movements toward and away from said second rocker arm between a projected position and a retracted position, abutting means provided on said second arm for abutting engagement with said plunger when said plunger is in the projected position, locking means movable in a direction perpendicular to said plungers between an operative position wherein the locking means locks said plungers in the projected position and an inoperative position wherein the locking means is disengaged from said plungers, actuator means for moving said locking means to the inoperative position under a low engine speed and to the operative position under a high engine speed.

* * * * *